United States Patent [19]

Morane

[11] 4,304,342

[45] Dec. 8, 1981

[54] CLOSURE DEVICE FOR A PRESSURIZED CONTAINER

[75] Inventor: Bruno P. Morane, Paris, France

[73] Assignee: L'Oreal, Paris, France

[21] Appl. No.: 121,966

[22] Filed: Feb. 15, 1980

[30] Foreign Application Priority Data

Feb. 20, 1979 [FR] France ..... 79 04282

[51] Int. Cl.³ ..... B65D 83/14

[52] U.S. Cl. ..... 222/402.23; 222/501

[58] Field of Search ..... 222/402.13, 402.21, 222/402.22, 402.23, 402.25, 501, 513, 507, 529, 563, 528

[56] References Cited

U.S. PATENT DOCUMENTS 3,182,864 5/1965 Ellis et al. ..... 222/402.25

3,759,427 9/1973 Stanley et al. ..... 222/402.23

4,203,534 5/1980 Finke ..... 222/402.21 X

*Primary Examiner*—Stanley H. Tollberg

*Attorney, Agent, or Firm*—Brisebois & Kruger

[57] ABSTRACT

A closure device for the neck of a pressurized container comprises a dispensing nozzle provided with a skirt adapted to be secured to the neck of the container. A closing member within the nozzle comprises an actuating rod extending lengthwise towards the tip of the nozzle and an obturator having an annular wall normally sealingly engageable with a cylindrical internal wall portion of the nozzle. The cylindrical wall portion is connected to the portion of the nozzle containing the actuating rod by an elastically deformable portion whereby the nozzle can be tilted to tilt said rod and release the seal between the obturator and the cylindrical internal wall portion of the nozzle.

16 Claims, 4 Drawing Figures

CLOSURE DEVICE FOR A PRESSURIZED CONTAINER

DESCRIPTION

This invention relates to an improved closure device for a pressurized container.

It is known that, in place of the outlet valves with which pressurised containers or "aerosol cans" are commonly equipped, it is possible to provide a simplified closing device, generally in two or three pieces, which is fixed onto the neck of the container by snapping-on. One device of this type comprises a dispensing cap having a skirt portion provided with attachment means for ensuring the fixing of the cap on the neck of the container, and a dispensing nozzle portion having the rod of an obturator housed therein.

In a proposed embodiment, the dispensing nozzle is joined to the fixing skirt by an elastically deformable, annular shoulder. Mounting the dispensing cap on the neck has the effect of applying the obturator against the neck with a sufficient bearing pressure to produce a seal. To carry out a dispensing operation, the user tilts the dispensing nozzle (and consequently the obturator rod housed therein) by elastically deforming the annular shoulder and this makes it possible to raise the obturator from the neck of the container and to break the seal. When the user releases the nozzle, the latter resumes its original position and the obturator closes the neck of the container again.

A closing device of this kind has been intended for dispensing cosmetic substances or the like, in a divided form or in the form of a foam, from a container which is pressurised by means of a conventional type of propellant. Amongst these propellants, examples which may be mentioned are halogenoalkanes known under the name "Freons," liquefied hydrocarbons, such as butane or propane, or compressed gases capable of dissolving at least partially in the packaged liquid, such as, for example, carbon dioxide or nitrous oxide.

This type of closing device with a tiltable nozzle exhibits a dual disadvantage:

firstly, the bearing pressure producing the seal is in opposition to the pressure inside the container; if the pressurised container is subjected to a temperature change, the pressure prevailing inside the container may increase, with the resulting risk that uncontrolled leaks of the packaged product may occur; and secondly, the neck of the container constitutes the seat of the obturator, with the result that the closing device cannot be fixed on all the existing types of container. In fact, the internal diameter of the neck must be of the appropriate size and, since the rim of the neck constitutes the seat of the obturator, it is essential for it to have a sufficiently plane surface to enable a good seal to be produced. Moreover, the obturator must be applied against the rim of the neck with a sufficient elastic clamping force. Furthermore, the closing device is fixed onto the neck of the container by snapping the fixing skirt, with which the closing device is provided, around the neck; consequently, the fixing skirt, and also the neck, must have precise dimensional characteristics so that, once it is in position, the obturator is applied against the neck with the appropriate clamping force.

The object of the present invention is to overcome the abovementioned disadvantages and, for this purpose, it proposes to produce a closing device, with a tiltable nozzle, in which device the obturator cooperates not with the neck of the container but with the actual wall of the nozzle, in order to ensure the seal required to close the container. Moreover, the closing device according to the invention is designed so that the seal is ensured even if there is an increase in the pressure prevailing inside the pressurised container as a result of a temperature increase.

According to the present invention there is provided a closure device for mounting on the neck of a container containing a pressurised liquid product to be dispensed and comprising a dispensing cap of an elastically deformable material and a closing member mounted within the dispensing cap, the dispensing cap comprising a dispensing nozzle portion having an axial channel therethrough and a skirt portion provided with attachment means for securing of the cap onto the neck of the container, the skirt and nozzle portions being connected by an elastically deformable peripheral wall zone, and the closing member comprising an actuating rod housed inside the axial channel in the nozzle and an obturator connected to said rod and provided with an annular side wall which is normally sealingly engageable with a surrounding wall portion of the cap, the arrangement being such that upon deformation of the said deformable wall zone consequent upon the nozzle portion of the cap containing the rod tilting relative to the part of the cap which contains the obturator the seal between the obturator and the said side wall is broken.

In a preferred embodiment, the nozzle is joined to the fixing skirt by an annular shoulder which bears on the neck of the container; the actuating rod, which is integral with the obturator, is provided with ribs extending parallel to its axis, the diameter of the rod, measured at the top of the ribs, being substantially equal to the internal diameter of the part of the nozzle which surrounds the actuating rod; the dispensing cap is a body of revolution about an axis which coincides with that of the neck of the container when the cap is fixed on the latter; the means for attaching the fixing skirt to the neck of the container are located on the internal face of the said skirt and consist of a peripheral ring which snaps inside an annular groove provided on the external wall of the neck; the dispensing nozzle is essentially in the form of a hollow finger having a rounded end with the dispensing orifice being provided therein.

In a first embodiment, the obturator and the part of the nozzle which surrounds it are located on the outside of the neck of the container. In this case, the obturator comprises a cylindrical end part which is located opposite the neck of the container and forms a seal with the wall of the nozzle which surrounds it, and an intermediate part-spherical portion, which joins the cylindrical end part to the actuating rod; the peripheral wall of the nozzle essentially matches in shape the side wall of the obturator and of the associated actuating rod, the cylindrical end part of the obturator being surrounded by a thick-walled zone of the cap, whilst the spherical intermediate part of the obturator is surrounded by a thin-walled zone of the cap, which is capable of being elastically deformed when the part of the nozzle which contains the actuating rod is tilted; ribs are preferably provided on the intermediate part of the obturator, the said ribs extending from the cylindrical end part, which forms the seal, to the zone in which the obturator is joined to the actuating rod.

In a second embodiment, the dispensing nozzle is extended inside the neck of the container by a cylindrical internal skirt in which the obturator is housed, the said internal skirt bearing against the wall of the neck which surrounds it. In this case, the axis of the cylindrical internal skirt essentially coincides with the axis of the skirt for fixing the cap on the neck of the container; at least one deformable peripheral lip, which ensures the seal between the neck and the cylindrical internal skirt, is provided in relief on the external wall of the said internal skirt; the obturator comprises a side wall in the form of a portion of a sphere, which narrows in the direction of the zone in which the obturator is joined to the actuating rod, and the annular zone of the obturator, which forms the seal, consists of the circular rim of greatest diameter of the said portion; the free end of the actuating rod, which is not joined to the obturator, being at a distance from the bottom of the nozzle where the ejection orifice is made, ribs being provided in relief inside the axial channel in the nozzle, between the bottom in which the ejection orifice is made and the free end of the actuating rod.

In order to provide a better understanding of the subject of the present invention, two embodiments thereof, shown in the accompanying drawings, will be described below by way of purely illustrative and non-limiting example.

Figure 2:
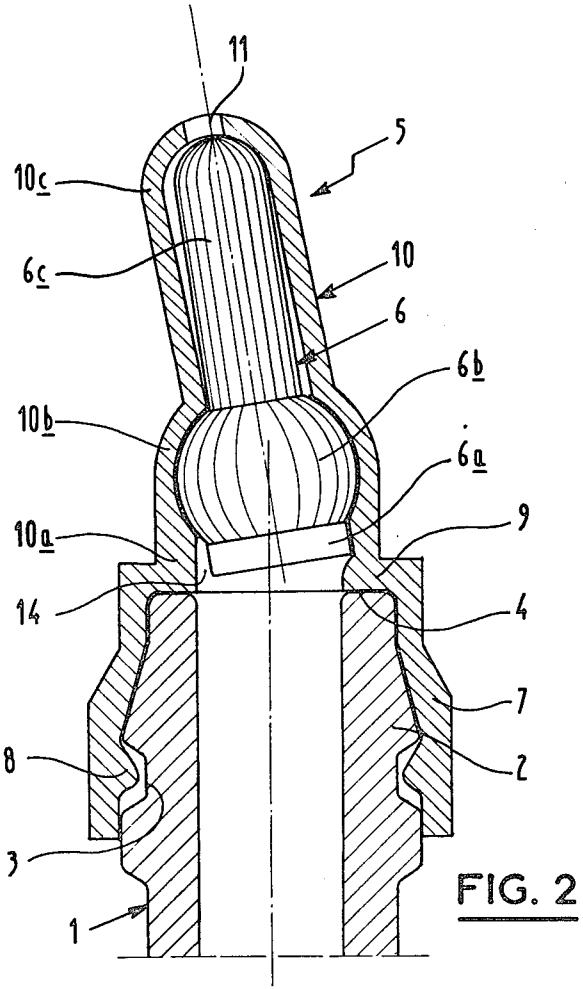
FIG. 2 is a view similar to FIG. 1 but showing the nozzle of the closing device tilted for dispensing.
Figure 1:
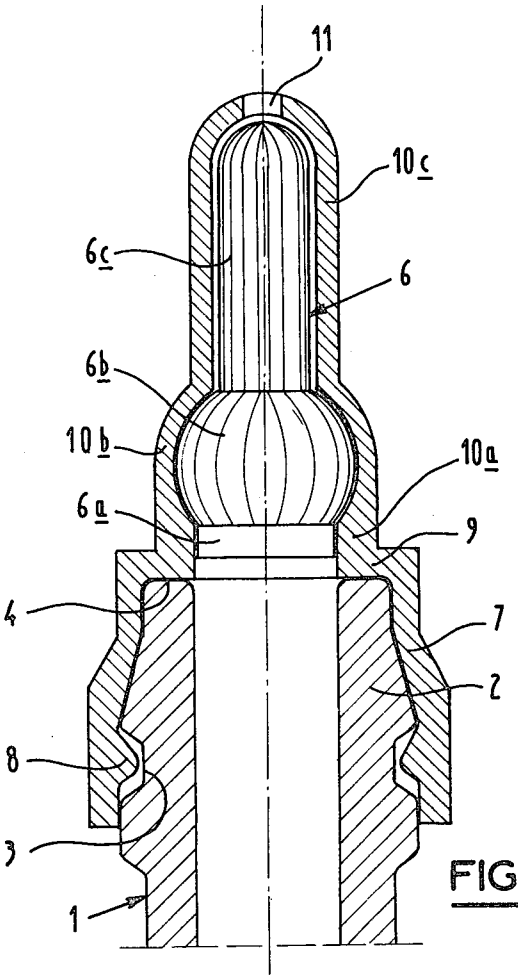
FIG. 1 shows, in axial section, the upper part of a container with which a closing device embodying the invention is associated.

With reference to FIGS. 1 and 2, there is shown the top of a pressurised container 1, inside which a liquid product is packaged, it being desired to dispense the product in a divided form or in the form of a foam, which has been designated by 1 in its entirety. The container 1 is pressurized, in the conventional manner, by means of a propellant fluid such, as for example, a "Freon."

The container 1 terminates in a neck 2, an annular groove 3 being provided in the peripheral wall of the neck 2. Externally, the neck has a frusto-conical shape, the cross-section of which decreases from the annular groove 3 towards the rim 4 of the neck. This tapered configuration is produced for the purpose of facilitating the positioning of a closing device, with a tiltable nozzle, which consists of two pieces, namely an external piece formed by a dispensing cap 5 and an internal piece comprised by an obturator unit 6.

The dispensing cap 5 is produced in a single piece from an elastically deformable plastics material; it is essentially a body of revolution about an axis which coincides with the axis of the neck 2. The dispensing cap 5 is provided with a skirt 7 which ensures the secure fixing of the dispensing cap 5 on the pressurised container 1. The means for attaching the cap 5 to the container 1 are located on the internal face of the skirt 7 and consist of a peripheral snap-on ring 8 which cooperates with the annular groove 3 provided around the neck 2.

The fixing skirt 7 is joined to a nozzle portion of the dispensing cap 10 by an annular shoulder 9. The annular shoulder 9 bears on the extreme end rim 4 of the neck 2. The dispensing nozzle 10 is in the form of a finger, the axis of which substantially coincides with that of the neck 2 when the said nozzle is not mechanically actuated. The dispensing nozzle 10 is provided with an axial channel, inside which the obturator unit 6 is housed. The nozzle 10 delimits three successive channel sections, namely two cylindrical end sections **10*a*, 10*c*, and a part-spherical intermediate section 10*b*. The channel end section 10*c* communicates with an ejection orifice 11 in the nozzle, whilst the channel section 10*a* communicates with the internal volume of the container 1. The wall thickness of the channel section 10*b* is reduced relative to the wall thickness of the channel section 10*a***.

The obturator unit 6, which is housed inside the axial channel in the nozzle 10, is in the shape of a body of revolution, the axis of which coincides with the axis of the nozzle 10; the side wall of the unit 6 is of similar shape to the internal side wall of the nozzle 10. The obturator unit 6 comprises an actuating rod **6*c* located inside the channel section 10*c* of the nozzle 10. Ribs are provided on the actuating rod 6*c* and extend parallel to its axis. The diameter of the actuating rod 6*c*, measured at the top of the ribs, is slightly less than the diameter of the channel section 10*c*. The obturator unit 6 is provided with a cylindrical end portion 6*a* which, when the nozzle 10 is located along the axis of the neck, ensures the leaktight closure of the channel section 10*a*. In this case, the seal is produced between the cylindrical surface of the end 6*a* of the obturator unit 6 and the cylindrical surface of the channel section 10*a*, these surfaces being in contact. The cylindrical end 6*a* of the obturator unit 6, which ensures the leaktight closure, is joined to the actuating rod 6*c* by a part-spherical intermediate section 6*b*. The shape of this intermediate section 6*b* is complementary to the channel section 10*b*, inside which the said intermediate section is housed. Ribs are provided on the intermediate section 6*b* of the obturator; these ribs extend over this section from the cylindrical end 6*a* to the zone in which the obturator is joined to the actuating rod 6*c***, where they communicate with the ribs provided thereon.

In order to dispense the product packaged inside the pressurised container 1, the user tilts the dispensing nozzle 10 transversely by elastically deforming the thin wall of the channel section **10*b*, as illustrated in FIG. 2 of the drawing, and this has the effect of also tilting the actuating rod 6*c* and hence the cylindrical end 6*a* of the obturator unit 6, which forms the seal. During this operation, the thick-walled channel section 10*a* remains substantially fixed, whereas the cylindrical end 6*a* of the obturator unit 6 tilts inside the said section. The seal is therefore broken and a passage 14 is formed through which the packaged product can flow. From the passage 14, the product can pass into the spaces between the ribs on the intermediate section 6*b* of the obturator unit 6, and then into the spaces between the ribs on the actuating rod 6*c*, before escaping from the nozzle 10 through the ejection orifice 11. As soon as the user releases the pressure which he is exerting on the nozzle 10, the latter resumes its initial position by virtue of the elasticity of its wall. With its return action of the nozzle 10, the obturator unit 6 can tilt in the opposite direction—this movement being facilitated by the part-spherical shape of the intermediate section 6*b* of the obturator unit 6—until the obturator unit 6 is again centred inside the nozzle 10, that is to say until the axes of the nozzle 10 and of the obturator unit 6 again coincide. In this position, the cylindrical end 6*a* again blocks the channel section 10***a* of the nozzle in a leaktight manner.

Figure 4:
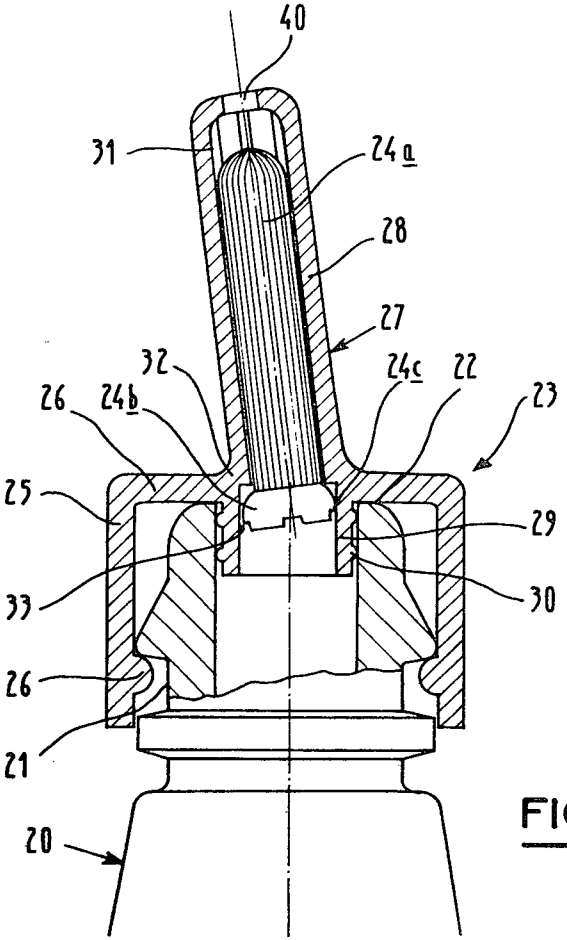
FIG. 4 is a view similar to FIG. 3 but showing the nozzle of the closing device tilted for dispensing.
Figure 3:
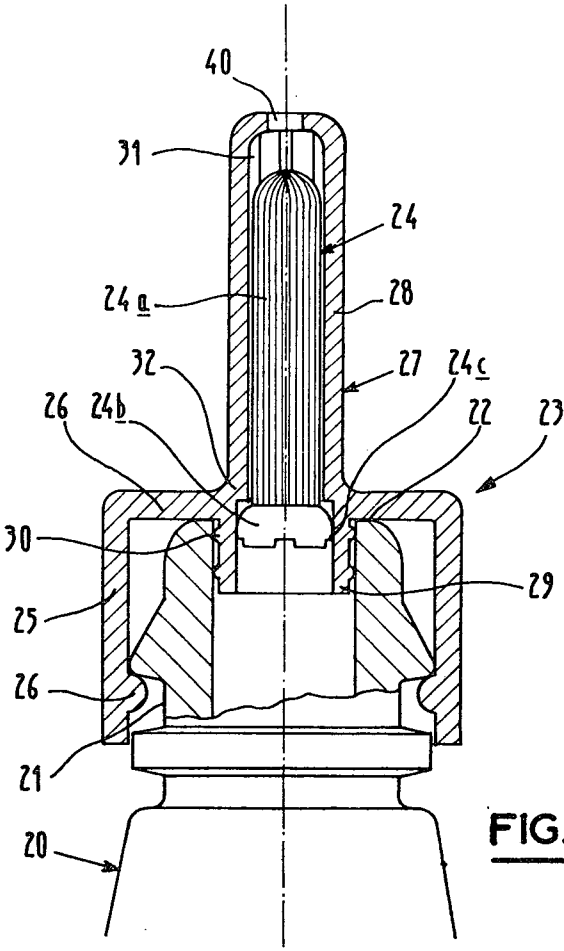
FIG. 3 shows, in axial section, the upper part of a pressurised container with which a second embodiment of closing device is associated.

FIGS. 3 and 4 of the drawing show a second variant in which part of the obturator is housed inside the neck of the container, whilst the obturator at the same time cooperates with the wall of the dispensing nozzle.

A pressurised container 20 is shown, the neck of which possesses an annular groove 21 on its external wall. The external wall of the neck has a tapered frustoconical shape, the cross-section of which decreases from the groove 21 towards the extreme rim 22 of the neck which has a rounded shape when viewed in cross-section.

The container 20 is fitted with a closing device consisting of two interlocking pieces, namely, a dispensing cap 23, and an obturator unit 24; the closing device ensures the leaktight closure of the container. The dispensing cap 23 is produced in a single piece by moulding an elastically deformable plastics material. The dispensing cap 23 is fixed on the neck of the container by means of a cylindrical skirt 25 having a peripheral ring 26 provided in relief on the internal wall thereof. The dispensing cap 23 is fixed by snapping the peripheral ring 26 inside the annular groove 21 provided around the neck.

The fixing skirt 25 of the dispensing cap 23 is joined to a dispensing nozzle 27 by an annular shoulder 26. The annular shoulder 26 bears on the rounded rim 22 of the neck. The axis of the dispensing nozzle 27 coincides with the axis of the neck when the said nozzle is not tilted. The dispensing nozzle 27 has an ejection orifice 40 provided in its rounded end. The dispensing nozzle 27 comprises a part 28 which projects outside the container 20; this external part 28 is extended inside the neck of the container by an internal skirt 29; the internal skirt 29 and the fixing skirt 25 which surrounds it are coaxial. The seal between the internal skirt 29 of the nozzle and the corresponding wall of the neck is ensured by the tight engagement of two peripheral lips 30 with the interior wall of the neck.

The obturator unit 24 is housed inside the cylindrical axial channel delimited by the dispensing nozzle 27. The obturator unit 24 consists of an actuating rod 24*a*, housed in the external part 28 of the nozzle, and of an obturator 24*b* which is located inside the sirt 29 and cooperates with the wall of the said skirt in order to ensure the leaktight closure of the container. The actuating rod 24*a* of cylindrical shape terminates, opposite the ejection orifice 40, in a rounded end. The actuating rod 24*a* comprises ribs which are provided over its whole length and which extend parallel to its axis; the diameter of the rod 24*a*, measured at the top of the ribs, is substantially equal to the internal diameter of the external part 28 of the nozzle. The actuating rod 24*a* is slightly shorter than the external part 28 of the nozzle. Ribs 31, parallel to the axis of the nozzle 27, are provided in relief, on the inside of the axial channel, in the region of the ejection orifice 40. The purpose of the ribs 31 is to prevent the rounded end of the actuating rod 24*a* from blocking the ejection orifice 40.

The obturator 24*b* comprises a side wall in the form of a portion of a sphere, the cross-section of which decreases in the direction of the location where the obturator is joined to the actuating rod 24*a*. When the nozzle 27 is not mechanically actuated, the circular rim 24*c* of greatest diameter of the obturator 24*b* extends perpendicular to the axis of the internal skirt 29. In this position, the circular rim 24*c* cooperates in a leaktight manner with the wall of the internal skirt 29 in order to ensure the closure of the container.

The dispensing nozzle 27 is joined to the shoulder 26 by a thin-walled peripheral zone 32 which is capable of being elastically deformed. The latter is located between the external part 28 of the nozzle and the internal skirt 29. To carry out a dispensing operation, the user transversely tilts the external part 28 of the nozzle and hence the actuating rod 24*a* located therein. This operation is made possible by virtue of the elastic deformation of the thin-walled peripheral zone 32; the internal skirt 29, which is centred inside the neck of the container, is not tilted, with the result that the circular rim 24*c*, which forms the seal, can pivot relative to the internal skirt 29; this has the effect of breaking the seal and of creating a passage 33, through which the liquid packaged in the container can flow. From the passage 33, the packaged liquid can flow through the spaces between the ribs which are provided on the actuating rod 24*a*, and can leave through the ejection orifice 40.

As soon as the user releases the pressure which he is exerting on the external part 28 of the nozzle, the latter returns to its original position by virtue of the elasticity of its wall. The circular rim 24*c* pivots in the opposite direction in order to resume a position in which it is essentially perpendicular to the axis of the internal skirt 29; in this position, the circular rim 24*c* is again gripped in a leaktight manner, over its whole periphery, by the internal skirt 29. The rounded configuration of the obturator 24*b* simplifies the centring of the obturator unit 24 inside the dispensing cap, that is to say to bring the axis of the obturator unit 24 into coincidence with that of the nozzle. Moreover, the rounded configuration of the obturator 24*b* makes it easier to position the obturator unit 24 inside the nozzle 27.

The modified embodiment of FIGS. 3 and 4 essentially offers the same advantages as the variant of FIGS. 1 and 2. However, it may be noted that a more satisfactory seal between the fixing skirt and the neck of the container is ensured in the variant of FIGS. 3 and 4, by virtue of the presence of the internal skirt 29 which is gripped inside the neck.

I claim:

1. A dispensing closure device for mounting on the neck of a container containing a pressurized liquid product to be dispensed, said device comprising:

(a) a dispensing cap of an elastically deformable material comprising a dispensing nozzle portion having an axial channel therethrough, and a skirt portion comprising means for securing the cap onto the neck of a container, (b) a closure member mounted within the dispensing cap and comprising an actuating rod housed inside the axial channel in the nozzle, and an obturator connected to said rod and operable by tilting of the nozzle portion relative to said skirt, (c) said obturator comprising an annular side wall, (d) said cap comprising a wall portion surrounding and normally sealing engaging said annular side wall of the obturator, and (e) an elastically deformable peripheral wall zone connecting the said skirt and nozzle portion of the cap whereby upon deformation of the said deformable wall zone in response to the nozzle portion of the cap containing the rod being tilted relative to the part of the cap which contains the obturator, the seal between the obturator and the said side wall is broken.

2. A closure device according to claim 1, including an annular shoulder joining the nozzle portion to the skirt, said annular shoulder being adapted to bear on the neck of the container.

3. A closure device according to claim 1, wherein the actuating rod is integral with the obturator and is provided with longitudinally extending ribs, the diameter of the rod, measured at the top of the ribs, being substantially equal to the internal diameter of that part of the nozzle by which it is surrounded.

4. A closure device according to claim 1, wherein the dispensing cap is a body of revolution about an axis which coincides with that of the neck of the container when the cap is fixed on the latter.

5. A closure device according to claim 1, wherein the means for attaching the fixing skirt to the neck of the container are located on the internal face of the said skirt and comprise a peripheral ring which is adapted to snap inside an annular groove provided on the external wall of the neck.

6. A closure device according to claim 1, wherein the nozzle portion has a rounded end and an ejection orifice is provided in said rounded end.

7. A closure device according to claim 1, wherein the obturator and the part of the cap which surrounds it are so located as to be outside the neck of the container when the closure device is secured thereon.

8. A closure device according to claim 7, wherein the obturator comprises a cylindrical end part which is sealingly engageable with the side wall of the cap which surrounds it and an intermediate part-spherical section which joins the cylindrical end part to the actuating rod.

9. A closure device according to claim 8, wherein the cap has a thick-walled zone surrounding the cylindrical end part of the obturator and the intermediate section of the obturator is surrounded by the elastically deformable wall zone which is thinner than said thick walled zone.

10. A closure device according to claim 8 or 9, wherein the intermediate section of the obturator has ribs provided thereon, the said ribs extending from the cylindrical end part to the location at which the obturator is joined to the actuating rod.

11. A closure device according to claim 1 wherein the cap has a cylindrical internal skirt adapted to extend inside the neck of the container and in which the obturator is housed, the said, internal skirt, in use of the device, bearing against the wall of the neck which surrounds it.

12. A closure device according to claim 11, wherein the axis of the cylindrical internal skirt substantially coincides with the axis of the said skirt portion provided with the attachment means.

13. A closure device according to claim 11 or 12, wherein said internal skirt has on its external wall at least one deformable peripheral lip for ensuring a seal between the neck of the container and the cylindrical internal skirt in use of the device.

14. A closure device according to claim 11 wherein the obturator comprises a part-spherical side wall, which narrows in the direction of the zone in which the obturator is joined to the actuating rod, the annular zone of the obturator, which forms the seal, consisting of the circular rim of greatest diameter of the said portion.

15. A closure device according to claim 1, wherein the actuating rod has a free end which is not joined to the obturator and which is spaced from the ejection orifice, ribs being provided inside the axial channel in the nozzle, between the end provided with the ejection orifice and the free end of the actuating rod.

16. A pressurised container having a liquid product packaged therein and provided with a closure device as claimed in claim 1.

* * * * *